US006997215B2

(12) United States Patent
Bühlmann

(10) Patent No.: US 6,997,215 B2
(45) Date of Patent: Feb. 14, 2006

(54) METHOD FOR WEAVING LOW FLAW CLOTHS BY MEANS OF THE ELIMINATION OF WEFT THREAD SECTIONS WHICH HAVE IRREGULARITIES

(75) Inventor: Andrea Bühlmann, Hinwil (CH)

(73) Assignee: Sultex AG, Rueti (CH)

( * ) Notice: Subject to any disclaimer, the term of this patent is extended or adjusted under 35 U.S.C. 154(b) by 195 days.

(21) Appl. No.: 10/779,202

(22) Filed: Feb. 13, 2004

(65) Prior Publication Data

US 2004/0221912 A1 Nov. 11, 2004

(30) Foreign Application Priority Data

Mar. 24, 2003 (EP) ..... 03405201

(51) Int. Cl.
*D03D 47/36* (2006.01)

(52) U.S. Cl. ..... 139/452; 139/450; 139/116.2

(58) Field of Classification Search ..... 139/450, 139/452, 116.2
See application file for complete search history.

(56) References Cited

U.S. PATENT DOCUMENTS 4,620,570 A * 11/1986 Suzuki ..... 139/116.2
4,941,513 A * 7/1990 Shaw ..... 139/116.2
4,974,640 A * 12/1990 Shaw ..... 139/116.2
4,989,644 A * 2/1991 Tanaka et al. ..... 139/116.2
5,016,676 A * 5/1991 Fourneaux et al. ..... 139/116.2
5,129,430 A * 7/1992 Mitsuya ..... 139/116.2
5,209,271 A * 5/1993 Takegawa ..... 139/116.2
5,351,721 A * 10/1994 Sawada et al. ..... 139/116.2
5,642,759 A * 7/1997 Wahhoud et al. ..... 139/116.2
5,746,256 A * 5/1998 Wahhoud et al. ..... 139/116.2
5,992,471 A * 11/1999 Chung ..... 139/116.2

FOREIGN PATENT DOCUMENTS

EP 0562230 A1 9/1993
EP 0656437 A1 6/1995

* cited by examiner

*Primary Examiner*—John J. Calvert
*Assistant Examiner*—Robert Muromoto
(74) *Attorney, Agent, or Firm*—Townsend and Townsend and Crew LLP

(57) ABSTRACT

The method for weaving low flaw cloths (4) comprises an elimination of weft thread sections which have irregularities (22, 22'). The method is carried out by means of a weaving machine (1) which in the presence of an irregularity on a weft thread (2) to be woven can be controlled in such a manner that at least one weft thread section which comprises the irregularity can be removed from the cloth being formed after an insertion operation. The irregularity is in each case detected by a sensor (23*a*, 23*b*, 23*c*) prior to the feeding in of the weft thread into a thread store (21). After the detection of the irregularity an incorporation of the weft thread into the cloth is prevented in that a shed forming apparatus (100), for example a dobby for the moving of heald frames (10), is controlled in such a manner that that all warp threads (3) of the cloth to be formed are deflected either downwardly or upwardly into positions to the side of a weft thread insertion line (2'). After the insertion operation the non-incorporated weft thread section is removed; or the weft thread sections are removed after two or more insertion operations.

9 Claims, 2 Drawing Sheets

Figure 1:
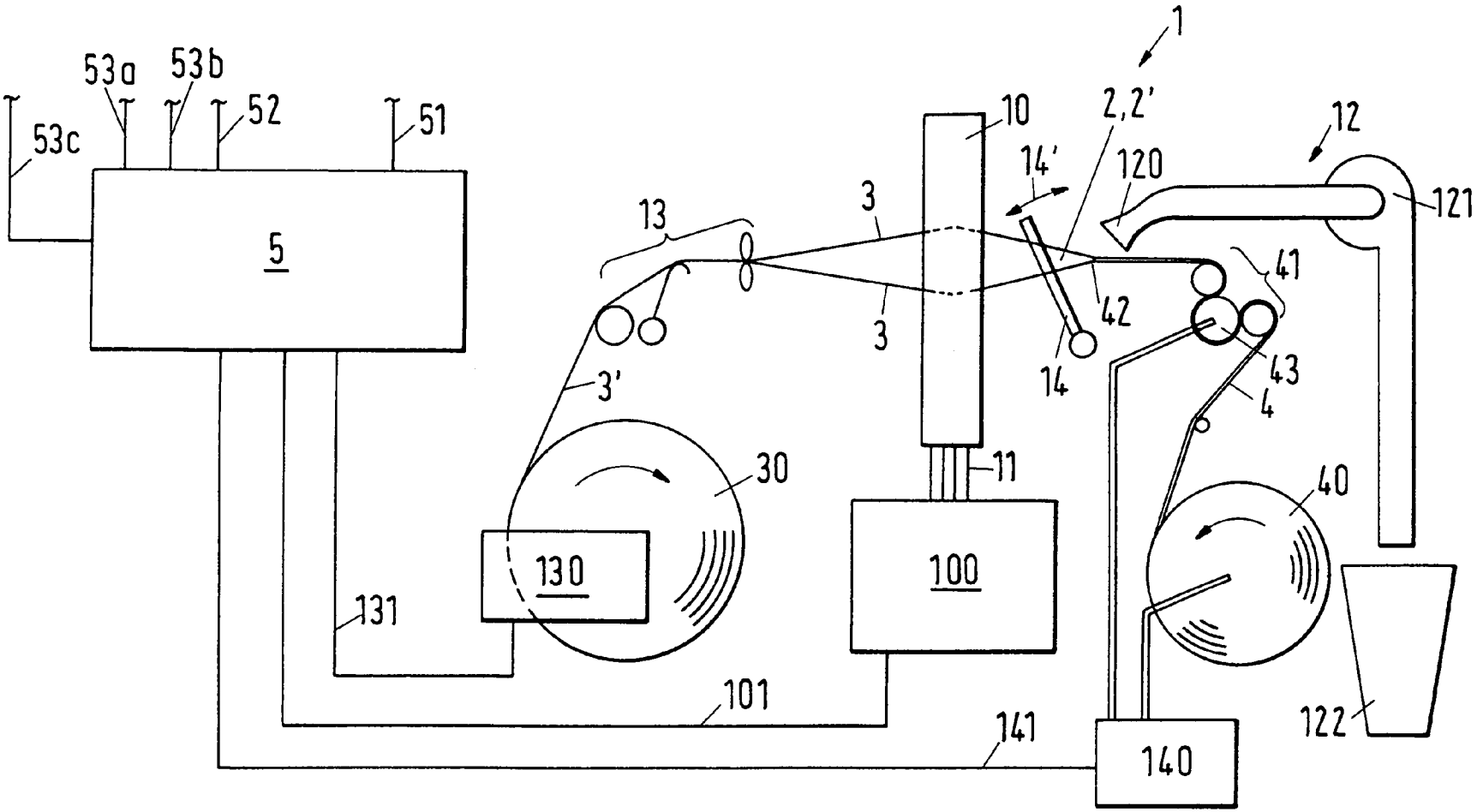

METHOD FOR WEAVING LOW FLAW CLOTHS BY MEANS OF THE ELIMINATION OF WEFT THREAD SECTIONS WHICH HAVE IRREGULARITIES

The invention relates to a method for weaving low flaw cloths by means of the elimination of weft thread sections which have irregularities in accordance with the preamble of claim 1. The invention also relates to a weaving machine on which the method in accordance with the invention can be carried out.

A method is known from EP-A-0 562 230 by means of which, for example, the weaving in of knots or other irregularities in weft threads can be prevented. If a sensor detects such an irregularity or abnormality or abnormal location, a weaving stop is initiated and then a weft thread section which contains the irregularity is eliminated through a programmed procedure, with the shed being open.

A weaving stop is disadvantageous, since it is as a rule associated with traces in the cloth, so-called restart positions, which signify a reduced cloth quality. When restart positions arise, the goal of obtaining a low flaw cloth is not achieved.

One possibility of being able to prevent the weaving stop consists in doubling the supply apparatuses for the weft threads. In the event that an irregularity is detected, a switchover to a reserve thread store could be made. This solution, which is known from EP-A-0 656 437, proves however to be disadvantageous for cost reasons.

The object of the invention is to create a further, economical method for the elimination of undesirable weft thread sections in which the elimination can be carried out without a stopping of the weaving machine and in which a doubling of the number of supply devices becomes unnecessary. This object is satisfied by the method which is characterized in claim 1.

The method for weaving low flaw cloths comprises an elimination of weft thread sections which have irregularities. The method is carried out by means of a weaving machine which, in the presence of an irregularity on a weft thread to be woven, can be controlled in such a manner that at least one weft thread section which comprises the irregularity can be removed from the cloth being formed after an insertion operation. The irregularity is in each case detected by a sensor prior to the feeding in of the weft thread into a thread store. After the detection of the irregularity an incorporation of the weft thread into the cloth is prevented in that a shed forming apparatus, for example a dobby for the moving of heald frames, is controlled in such a manner that that all warp threads of the cloth to be formed are deflected either downwardly or upwardly into positions to the side of a weft thread insertion line. After the insertion operation the non-incorporated weft thread section is removed or the weft thread sections are removed after two or more insertion operations.

Thanks to the method in accordance with the invention an open shed is not present when insertion operations with undesirable sections of the weft threads take place. Without the shed being open, the weft threads can not be beat up and bound in at the cloth edge by the weaving sley, which continues to execute its oscillatory movement between warp threads which cross one another. Thus the thread sections to be eliminated remain in an unbound state, from which they can be removed, for example sucked off, without offering any substantial resistance.

Subordinate claims 2 to 8 relate to advantageous embodiments of the method in accordance with the invention. A weaving machine which comprises components by means of which the method in accordance with the invention can be carried out is the subject of claim 9.

Figure 2:
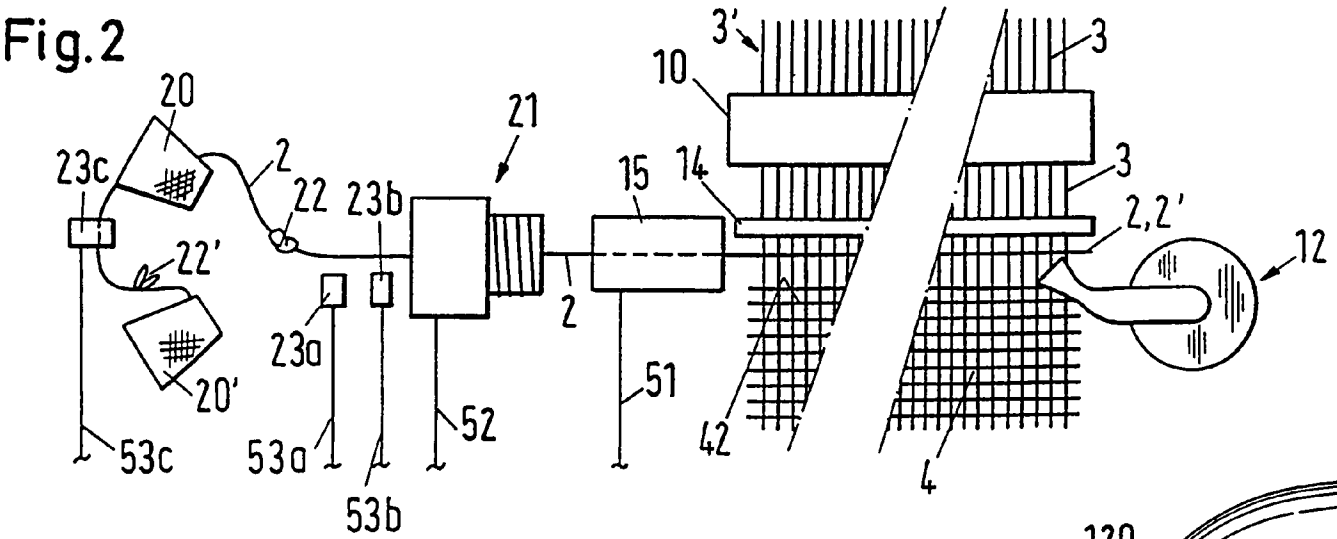
Figure 3:
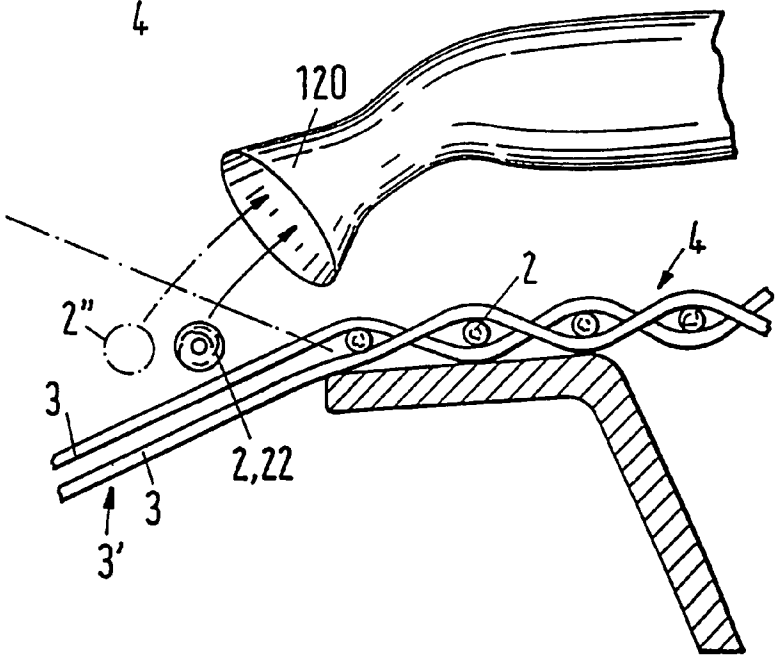

The invention will be explained in the following with reference to the drawings. Shown are:

FIG. 1 a schematic side view of a weaving machine;

FIG. 2 a corresponding plan view;

FIG. 3 a part of a suction device.

The method in accordance with the invention can be carried out using a weaving machine 1 such as is illustrated in FIGS. 1 and 2. A weft insertion can take place by means of projectiles, rapiers or a fluid, in particular air. The components which are required for this method are a controllable shed forming apparatus 100 (e.g. a dobby), at least one sensor, namely sensors 23*a* and/or 23*b*, by means of which a weft thread 2 (in which a knot 22 is located) can be monitored directly after a supply bobbin 20, and an elimination member, namely a suctioning off member 12 for sucking away weft thread sections to be eliminated. The following components can also be seen in FIGS. 1 and 2, in addition to those already named:

A group of heald frames 10 with drive bars 11, which are moved up and down by the shed forming apparatus 100 in accordance with a program; a weaving sley 14, which executes an oscillatory movement 14'; warp threads 3 of a warp 3'; a warp beam 30 and an electrical warp thread let off 130; various machine parts 13 for the purpose of a guiding and tensioning of the warp threads 3; a produced cloth 8 (the "ware") with a cloth edge 42 which extends alongside an insertion line 2' of the weft thread 2 and parallel to it; various deflection elements 41 with a floating take-up beam 43; a cloth beam 40 and an electrical cloth take up 140, which acts on the cloth beam 40 and the floating take-up beam 43; a blower 121 for the suction member 12 and a receptacle 122 for the weft thread sections to be eliminated.

In FIG. 2 the following components can also be seen: A thread supply in the form of the thread bobbin 20, the rear thread end of which is knotted to a front thread end of a second bobbin 20' which is standing in readiness (knot 22'), a further sensor 23*c*, a weft thread store 21 and a device 15 which is part of a weft insertion system and which contains a severing member. The weft insertion is carried out for example by means of an air jet. The severing member severs the inserted weft thread at the end of an insertion operation, so that the latter is bound into the cloth as a separate thread section or—in the carrying out of the method in accordance with the invention—lies unbound in readiness to be removed (sucked away).

A control device 5 (FIG. 1) of the weaving machine 1 is connected via signal lines to the components of the weaving machine, namely to the warp thread let off 130 by a line 131, to the dobby 100 by a line 101, to the cloth take up 140 by a line 141, to the device 15 by a line 51, to the weft thread store 21 by a line 52 and to the sensors 23*a*, 23*b* and 23*c* by lines 53*a*, 53*b* and 53*c* respectively.

If an irregularity, for example a knot 22 or some other thickening, is present on the weft thread 2 to be woven in, then the weaving machine 1 is controlled in such a manner that after an insertion operation at least one weft thread section which comprises the irregularity can be removed from the cloth 4 which is being formed. The irregularity is detected by the sensor 23*a* before the feeding of the weft thread 2 into the thread store 21. After the detection of the irregularity, a binding of the weft thread into the cloth 4 is prevented in that the shed forming apparatus 100, i.e. the drive mechanism for the heald frames 10, is controlled in such a manner that all warp threads 3 are brought into positions in the warp thread deflection direction and to the side of the weft thread insertion line 2'. This is illustrated in FIG. 3. The side positions of the warp threads 3 are located in one discrete zone which lies outside the insertion line 2'. All the warp threads 3 of the cloth to be formed are thus deflected into positions which are either below or above the weft thread insertion line.

After the insertion operation the weft thread section 2 which is not bound in and which bears the knot 22 is removed by a suction nozzle 120 of the suction member 12. Two or more weft thread sections 2" (indicated by chain dotted lines in FIG. 3) can also be present after further subsequent insertion operations, and are then removed together. Such a multiple dispensation of weft thread sections is present when this can not be prevented as a result of limited possibilities in the programming of the shed forming apparatus. The weft threads 2 can not be bound in again until the shed forming apparatus has positioned the heald shafts in accordance with a programmed cloth pattern. The normal weaving rhythm must be resumed where it had been interrupted prior to the intervention in accordance with the invention.

Irregularities of the weft thread in the form of thin locations can also be detected by the sensor 23*a* or the sensor 23*b*, with which a further sensor comes into use. At such a location in the weft thread a diameter is measured which is less than the average diameter of the weft thread by a predetermined percentage.

In changing from bobbin 20 to bobbin 20' the sensor 23*c* detects the passage of the connecting knot 22'. For this knot 22' as well, the method in accordance with the invention comes into use with a corresponding elimination of the irregularity.

A main drive of the weaving machine 1 continues to be operated during the removal of the weft thread section to be eliminated. However, the operations for the warp thread let off 130 and the cloth take up 140 must be briefly interrupted for the compensation of the weft thread 2 which is not bound in, so that the cloth edge, i.e. the edge 42 of the cloth 4, remains in a stationary position or largely in a stationary positioned. The programming of the control system must take into account that the movement of the cloth 4 which is caused by the cloth take up 140 has a braking distance during the interruption and a starting distance during the subsequent resumption, so that as a result of taking appropriate measures a deviation of the cloth edge from the stationary position remains a minimum. After resumption of the normal weaving operation the operations of the warp thread let off 130 and the cloth take up 140 must again be carried out in a synchronized manner.

There are shed forming apparatuses 100 in which at least one additional weft thread section is bound into the cloth after the detection of the irregularity before the elimination of the irregularity in accordance with the invention can take place. Each of these additional weft thread sections must be intact, i.e. free from irregularities. Therefore a correspondingly large supply of intact weft threads must be present on the thread store 21.

What is claimed is:

1. Method for weaving low flaw cloths (4) by means of the elimination of weft thread sections which have irregularities (22, 22'), said method being carried out by means of a weaving machine (1) which in the presence of an irregularity on a weft thread (2) to be woven can be controlled in such a manner that at least one weft thread section which comprises the irregularity can be removed from the cloth being formed after an insertion operation, characterized in that the irregularity is in each case detected by a sensor (23*a*, 23*b*, 23*c*) prior to the feeding in of the weft thread into a thread store (21); in that after the detection of the irregularity an incorporation of the weft thread into the cloth is prevented in that a shed forming apparatus (100) is controlled in such a manner that all warp threads (3) of the cloth to be formed are deflected either downwardly or upwardly into positions to the side of a weft thread insertion line (2'); and in that, after the insertion operation, the non-incorporated weft thread section is removed or the weft thread sections are removed after two or more insertion operations.

2. Method in accordance with claim 1, characterized in that the elimination of weft thread sections is carried out without a stopping of the weaving machine drive.

3. Method in accordance with claim 1, characterized in that a supply device for which an irregularity (22, 22') of the weft thread is detected is not replaced by a further supply device which is held in reserve.

4. Method in accordance with claim 1, characterized in that irregularities which are thickenings of the weft thread (2), in particular knots (22, 22'), are detected by the sensor (23*a*).

5. Method in accordance with claim 4, characterized in that irregularities (22, 22') of the weft thread at which in each case a measured value of the thread diameter is less than the average diameter of the weft thread (2) by a predetermined percentage are detected by the sensor (23*a*) and/or by a further sensor (23*b*).

6. Method in accordance with claim 1, characterized in that a main drive of the weaving machine (1) continues to be operated during the removal of the weft thread section to be eliminated, with however operations of a warp thread let off (130) and of a cloth take up (140) of the non-incorporated weft thread (2) being briefly interrupted so that the edge (42) of the cloth (4) remains in a stationary position or largely in a stationary position at the insertion line (2').

7. Method in accordance with claim 6, characterized in that, with a programmed controlling of the cloth take up (140) and/or of the warp thread let off (130), the occurrence of a braking distance during the interruption as well as of a starting distance during the subsequent resumption are taken into account, so that as a result of corresponding measures for the correction of deviations no changes in the cloth pattern arise.

8. Method in accordance with claim 1, characterized in that, after the detection of the irregularities (22, 22') and depending on the shed forming apparatus (100) used, at least one additional weft thread section with the production of a binding is dispensed before the elimination of the irregularity can take place; in that each of these additional weft thread sections is free from irregularities; and in that a correspondingly large weft thread supply is present at the thread store (21).

9. Weaving machine (1), in which a weft insertion takes place by means of projectiles, rapiers or a fluid, in particular air, characterized by components by means of which the method in accordance with claim 1 can be carried out, with a controllable shed forming apparatus (100), an electrical cloth take up (140) and warp thread let off (130), at least one sensor (23*a*, 23*b*, 23*c*) for the monitoring of a weft thread (2) after a supply bobbin (20), and an elimination member (12) for the weft thread section to be eliminated are included as components.

* * * * *